United States Patent [19]

Lin

[11] Patent Number: 4,958,508

[45] Date of Patent: Sep. 25, 1990

[54] DOUBLE HOOK-BOLT MORTISE LOCK

[76] Inventor: Emily M. Y. Lin, No. 112, Sze Chuan Rd., Sec. 1, Panchiao City, Taipei Hsien, Taiwan

[21] Appl. No.: 428,982

[22] Filed: Oct. 30, 1989

[51] Int. Cl.[5] ..... E05B 25/02

[52] U.S. Cl. ..... 70/352; 70/355; 292/51

[58] Field of Search ..... 70/137, 352, 350, 351, 70/355; 292/25, 51, 112

[56] References Cited

U.S. PATENT DOCUMENTS

| | | | |
|---|---|---|---|
| 567,290 | 9/1896 | Bruns | 70/355 |
| 982,863 | 1/1911 | Phillips | 70/352 |
| 1,386,641 | 8/1921 | Marino | 70/355 |
| 1,829,596 | 10/1931 | Lality | 70/352 |
| 1,829,938 | 11/1931 | Kromer | 70/355 |
| 4,587,815 | 5/1986 | Gil | 70/352 |

FOREIGN PATENT DOCUMENTS

| | | | |
|---|---|---|---|
| 32537 | 11/1923 | Denmark | 70/350 |

*Primary Examiner*—Robert L. Wolfe

*Attorney, Agent, or Firm*—Asian Pacific International Patent an Trademark Office

[57] ABSTRACT

A double hook-bolt mortise lock includes a cam form tumbler plate assembly comprised of a plurality of cam form tumbler plates driven by the steps of a key to define a space passage for passing therethrough of the key into a brake notch to further drive the cross bar of a main brake frame to move from one stop hole to the other. During movement of the main brake frame, an auxiliary brake frame is carried by means of two idle gears to make a rectilinear motion toward or against the main brake frame so as to drive the gears of two hook bolts to rotate, by means of the rack portions of the main and auxiliary brake frame, to further let the two hook bolts lock up with or lock from a striking plate.

7 Claims, 4 Drawing Sheets

DOUBLE HOOK-BOLT MORTISE LOCK

BACKGROUND OF THE INVENTION

A regular mortise lock, unit lock or latch generally utilizes a latch bolt that has a rectilinear motion to lock up with or unlock from a striking plate mounted on a door frame so as to lock or unlock a door.

The lock which locks a door by means of the rectilinear motion of a latch bolt may be easily destroyed by burglars through violence. In a regular one-step locking device, the single latch bolt is driven only a limited distance into the notch of a striking plate mounted on a door frame. Through severe impact force against the door, the door panel and the latch bolt will be easily deformed, and the latch bolt will be pushed out of the associated striking plate to unlock the door (This is commonly seen in TV programs). In a regular two or three-step locking device (which comprises two or three latch bolts), the door still cannot be well protected against violence. Although the latch bolts are inserted more deeply in the notches of a striking plate, the range of the latch bolts into the notches of a striking plate is still limited by the thickness of a door frame. If a regular two or three-step locking device is used to lock a door, a burglar may hit the door to open it after having inserted a crowbar into the gap between the door panel and the associated door frame to pry the door panel in or out.

SUMMARY OF THE INVENTION

The main object of the present invention is to provide a double hook-bolt mortise lock to accurately and firmly lock up with a striking plate against damage by violence or a crowbar.

The mortise lock of the present invention utilizes a rectilinear rack to rotate a gear such that the displacement of a main brake frame drives an auxiliary brake frame, by means of two idler gears, to further rotate the gears of two hook bolts so as to let the two hook bolts move in circular arcs to effectively lock up with a striking plate.

BRIEF DESCRIPTION OF THE DRAWINGS

Further objects and advantages of the invention will be apparent from a reading of the following detailed description, taken in conjunction with the figures of the accompanying drawings, in which.

DETAILED DESCRIPTION OF THE PREFERRED EMBODIMENT

Figure 1:
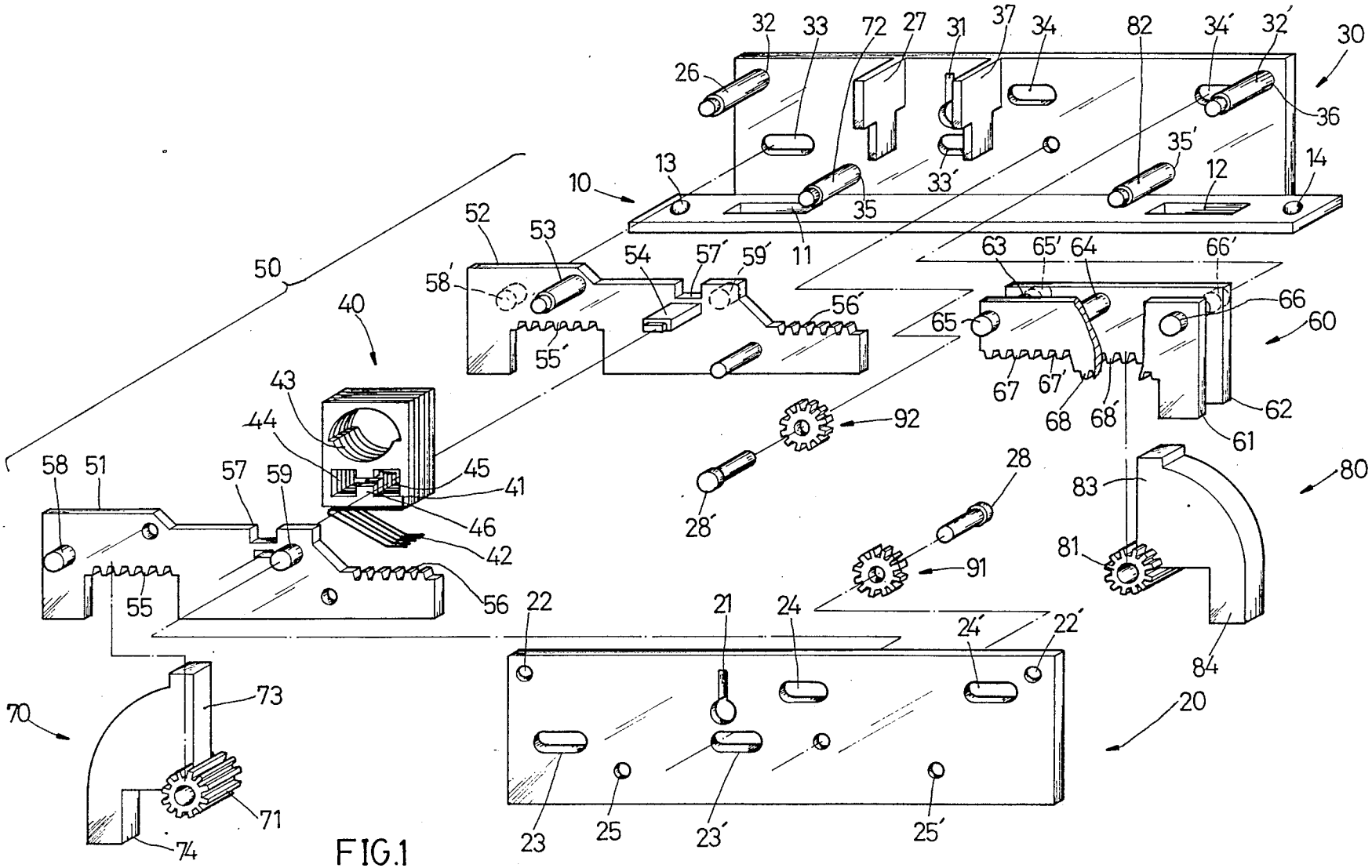
FIG. 1 is a perspective exploded view of a double hook-bolt mortise lock embodying the present invention.

Turning now to the annexed drawings in detail and first referring to FIG. 1, therein illustrated is a double hook-bolt mortise lock embodying the present invention and generally comprised of a face plate (10), two cover plates (20) and (30), a cam form tumbler plate assembly (40), a main brake frame (50), an auxiliary brake frame (60), two semi-circular hook-bolts (70) and (80), and two idler gears (91) and (92).

The face plate (10) comprises two elongated slots (11) and (12) for passing therethrough of the two semi-circular hook bolts (70) and (80), and two round holes (13) and (14) at both ends for mounting of the face plate (10) onto a door.

The two cover plates, i.e. the right and left cover plates (20) and (30) are symmetrically mounted on the face plate (10) at both sides, comprising key holes (21) and (31), fixed fastening holes (22) (22)' and (32) (32)', guide holes (23) (23)' and (33) (33)' for main brake frame, guide holes (24) (24)' and (34) (34)' for auxiliary brake frame 60, fastening holes (25) (25)' and (35) (35)', and pins (28) and (28)' for idler gears 91 and 92. The two cover plates (20) and (30) are bilaterally positioned in parallelism with each other by means of lock pins (26) (36) and supporting plates (27) and (37) to couple with the face plate (10) to form a casing for the lock.

The cam form tumbler plate assembly (40) is comprised of a plurality of cam form tumbler plates each having a circular arc shaped sliding hole (43), two stop holes (44) (45), a key portion (46), and a notch (41) at the bottom end for setting therein of a steel brake wire (42). The key portions (46) of the cam form tumbler plates of the cam form tumbler plate assembly (40) are respectively made in length to match with the size of the steps (210) of the key (200). According to the present invention, the steps (210) of the key (200) are properly made according to the number of cam form tumbler plates such that the highest step of the steps (210) of the key (200) is disposed against the longest key portion of the key portions (46) of the cam form tumbler plates of the cam form tumbler plate assembly (40) and the lowest step of the steps (210) of the key (200) is disposed against the shortest key portion of the key portions (46) of the cam form tumbler plates assembly (40). When the cam form tumbler plate assembly (40) is driven to move by the key (200), the steel brake wires (42) are stopped against the face plate (10). Therefore, the cam form tumbler plates of the cam form tumbler plate assembly (40) are pressed down by the steps (210) of the key (200) in respective range according to the height of the steps (210). According to the present invention, a hollow space is formed between the two stop holes (44) and (45) of each cam form plate of the cam form tumbler plate assembly (40) for passing therethrough of a cross bar (54) which is one component of the main brake frame (50).

The two semi-circular hook-bolts (70) and (80) are symmetrical and pivotably mounted on the left cover plate (30) by means of lock pins (72) and (82). Each hook bolt 70 Or 80 comprises a gear (71) or (81) fixedly mounted thereon, a raised stop portion (73) or (83), and a hook-end poriton (74) or (84). When the lock is driven to a locking position by the key (200), the raised stop portions (73) and (83) of the two semi-circular hook-bolts (70) and (80) are moved to stop against the face plate (10), and the hook-end portions (74) and (84) of the two semi-circular hook-bolts (70) and (80) are firmly locked up with a striking plate, not shown.

The main brake frame (50) is comprised of two brake plates (51) and (52) connected by means of a pin (53) and a cross bar (54) transversely set therebetween. The two brake plates (51) and (52) are symmetrical against each other, each comprising two rack portions (55) (56) or (55') (56'), a brake notch (57) or (57'), and two dowels

(58) (59) or (58') (59'). The dowels (58) (59) and (58') (59') of the two brake plates (51) and (52) are movably set in the guide holes (23) (23') and (33) (33') of the right cover plate (20) and the left cover plate (30).

The auxiliary brake frame (60) is comprised of two symmetric brake plates (61) and (62) connected together by means of two cross pins (63) and (64). The brake plates (61) and (62) each comprises two dowels (65) (66) or (65') (66'), an upper rack portion (67) or (67'), and a lower rack portion (68) or (68'). The dowels (65) (66) and (65') (66') of the two brake plates (61) and (62) are movably set in the guide holes (24) (24') and (34) (34') of the cover plates 20 and (30).

The two idler gears (91) and (92) are respectively mounted on the two pins (28) and (28') of the two cover plates (20) and (30) to drive the auxiliary brake frame (60) by means of the main brake frame (50). Each brake frame 50 or 60 is an actuator for the associated lock bolt 70 or 80.

Figure 2:
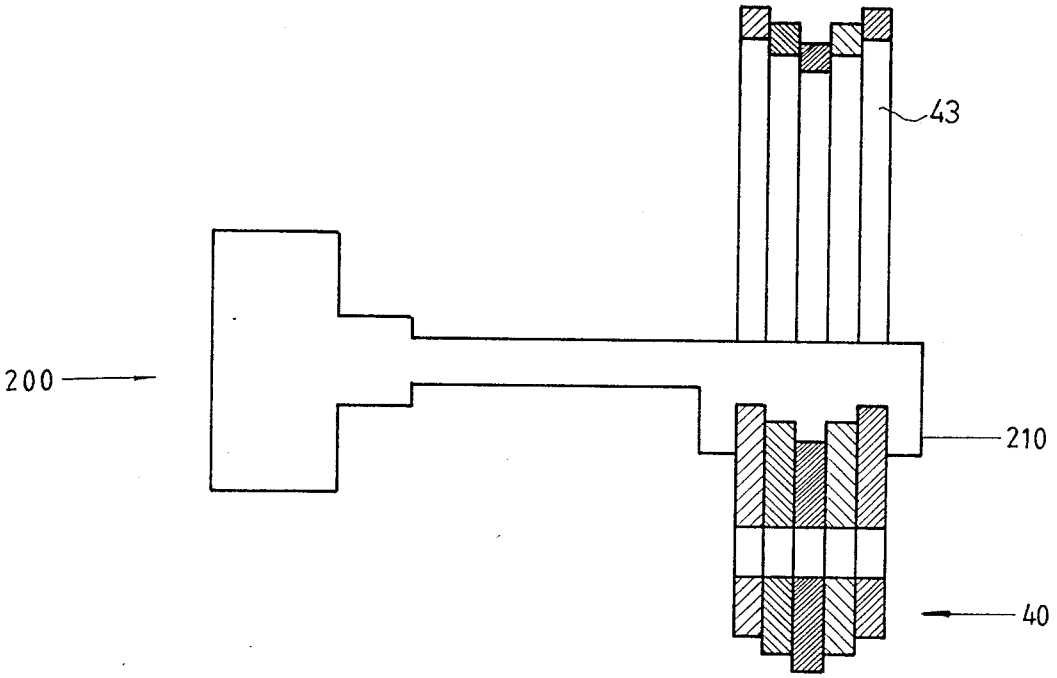
FIG. 2 illustrates the relative position of the steps of the key and the cam form tumbler plate assembly.
Figure 3:
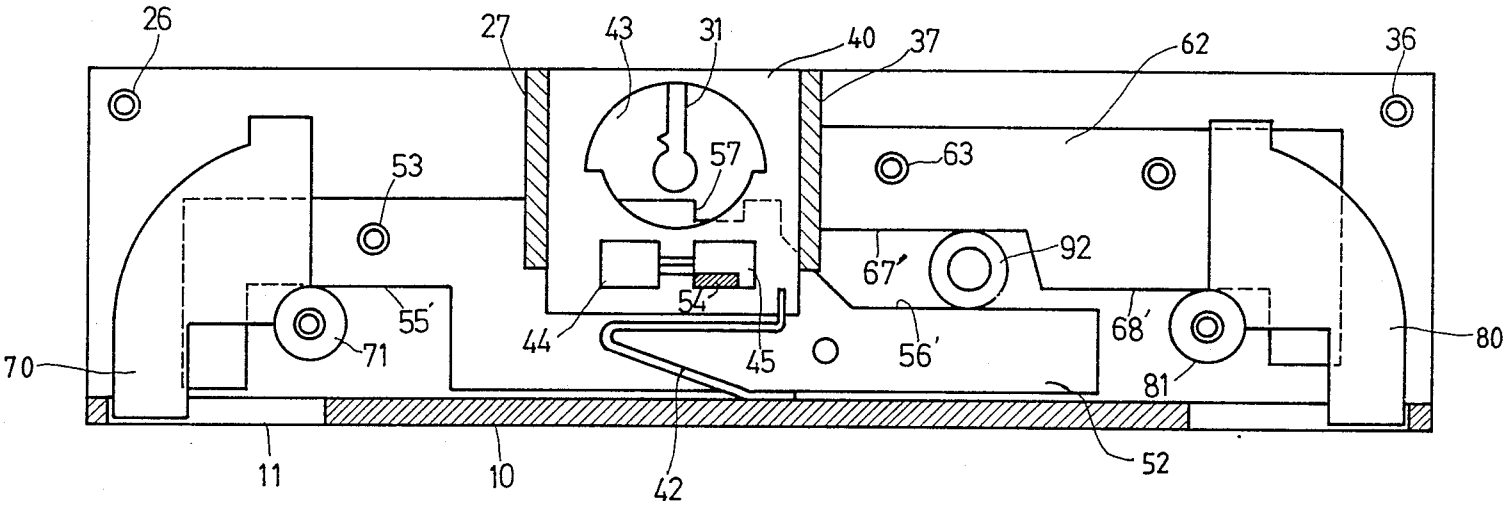
FIG. 3 is a schematic drawing illustrating the structural composition of the present invention when the lock is in an open mode.
Figure 4:
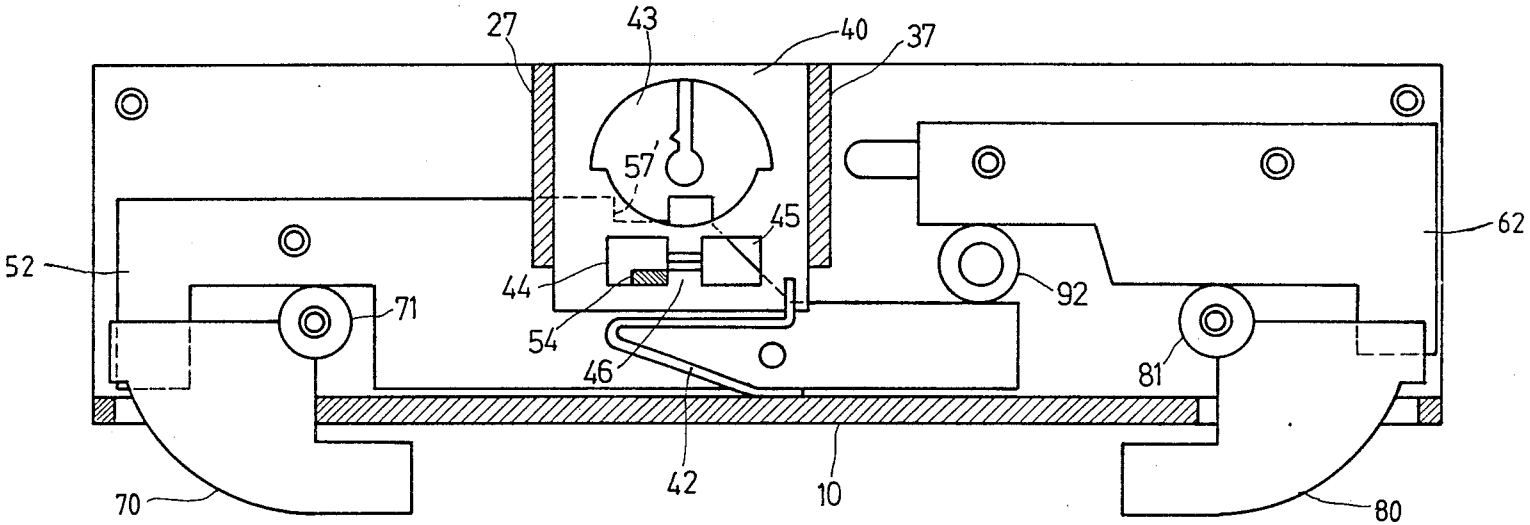
FIG. 4 is a schematic drawing illustrating the structural composition of the present invention when the lock is in a closed mode.

Referring to FIGS. 2 through 4, when the key (200) is inserted through the key hole (21) or (31) into the cam form tumbler plate assembly (40) form either side to lock up the associated door, the cam form tumbler plates of the cam form tumbler plate assembly (40) are respectively driven by the steps (210) to move vertically such that a passage is formed between the stop holes (44) and (45) of the cam form tumbler plate assembly (40) (as shown in FIG. 2). After key 200 has been inserted through the brake notches (57) and (57') of the main brake frame (50), the main brake frame (50) is further driven by the key to let the cross bar (54) move from one stop hole (44) or (45) to the other stop hole (45) or (44) through the passage formed between the stop holes (44) and (45) of the cam form tumbler plate assembly (40). When the main brake frame (50) is moved by the key move, the auxiliary brake frame (60) is simultaneously driven, by means of the two idler gears (91) and (92), to move rectilinearly away from the main brake frame (50). Through the effect of the rack portion (55) and (55') of the main brake frame (50) and the lower rack portions (68) and (68') of the auxiliary brake frame, the gears (71) and (81) of the two hook-bolts (70) and (80) are rotated. Therefore, the two semi-circular hook-bolts (70) and (80) are driven to respectively turn inward to further effectively lock up with the two notches of the associated striking plate, not shown.

The locking or unlocking mode of the present mortise lock is determined according to the position of the two semi-circular hook-bolts (70) and (80) against the associated striking plate. According to the present invention, the key (200) can be inserted into the present mortise lock either from an indoor or outdoor located to effectively lock up or unlock the door.

Many chages and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A lock comprising a hollow casing having two spaced slots (11 and 12) therein; separate lock bolts (70 or 80) swingably mounted within the casing adjacent the two slots for movement between retracted positions located entirely within the casing and operating positions extending through the associated slots; a tumbler plate assembly (40) centrally located within said casing between said slots; said tumbler plate assembly comprising a number of individual plates slidably arranged within the casing for movement to a depressed position in response to insertion of a key through the plate assembly; a first bolt actuator (50) slidably arranged within the casing for rectilinear movement transversely across the motion path of the tumbler plate assembly; said first actuator having a notch means (57) therein adapted to engage a key inserted into the lock casing, whereby key rotation is then effective to move said first actuator; said first actuator having a drive connection (55,71) with one of the lock bolts; a second bolt actuator (60) slidably arranged within the casing for rectilinear movement transverse to the motion path of the tumbler plate assembly; said second actuator having a second drive connection (68,81) with the other lock bolt; rotary pinion gear means (91,92) within said casing; first rock means (56) carried on said first actuator in meshed engagement with said pinion gear means; and second rock means (67) carried on said second actuator in meshed engagement with said pinion gear means, whereby said first actuator serves as a drive means for the second actuator.

2. The lock of claim 1, and further comprising a motion-limiter bar (54) extending from said first actuator through said tumbler plate assembly; the plates in said plate assembly having holes therethrough that are alignable to permit movement of said motion-limiter bar only when said plate assembly in its depressed position.

3. The lock of claim 2, wherein the hole in each tumbler plate comprises two relatively large openings (44 and 45) and a relatively narrow interconnecting passage, the motion-limiter bar being sized to move through the passages in the tumbler plates only when the plate assembly is in its depressed position.

4. The lock of claim 3, and further comprising an individual spring means (42) associated with each tumbler plate for moving that plate away from its depressed position.

5. The lock of claim 3, wherein the holes in said tumbler plates are oriented so that said holes are alignable when a key is inserted into the lock casing from either direction normal to the tumbler plate assembly.

6. The lock of claim 1, wherein each said drive connection comprises a pinion gear carried by the respective lock bolt and a rock carried by the respective actuator.

7. The lock of claim 1, wherein each actuator comprises two spaced parallel plate elements; said tumbler plate assembly being located between the planes of the actuator plate elements.

* * * * *